United States Patent [19]

Byrd

[11] Patent Number: 4,819,845

[45] Date of Patent: Apr. 11, 1989

[54] SKI CARRIER APPARATUS

[76] Inventor: Gary S. Byrd, 13425 Chinaberry La., Edmond, Okla. 73034

[21] Appl. No.: 710,971

[22] Filed: Mar. 12, 1985

[51] Int. Cl.[4] ..... A45C 11/78

[52] U.S. Cl. ..... 224/204; 224/205; 224/250; 224/917

[58] Field of Search ..... 224/202, 203, 205, 206, 224/208, 257, 258, 264

[56] References Cited

U.S. PATENT DOCUMENTS

| | | | |
|---|---|---|---|
| 435,101 | 8/1890 | Mann-Tiechler . | |
| 745,866 | 12/1903 | Laing | 224/203 |
| 796,589 | 8/1905 | Maloney . | |
| 1,296,619 | 3/1919 | Bulat . | |
| 1,844,068 | 2/1932 | Martin . | |
| 2,050,822 | 8/1936 | Weber et al. . | |
| 2,224,568 | 12/1940 | Altorfer . | |
| 2,385,315 | 9/1945 | Vanasse | 224/264 |
| 2,760,699 | 8/1956 | Rivers-MacPherson . | |
| 3,882,914 | 5/1975 | Strutz . | |
| 4,298,149 | 11/1981 | Gottschalk et al. . | |
| 4,308,982 | 1/1982 | Hall . | |
| 4,456,284 | 6/1984 | Saka . | |

FOREIGN PATENT DOCUMENTS

| | | |
|---|---|---|
| 2214104 | 9/1973 | Fed. Rep. of Germany . |
| 9971 | 4/1902 | United Kingdom . |

*Primary Examiner*—William A. Cuchlinski, Jr.

*Attorney, Agent, or Firm*—Dunlap, Codding & Peterson

[57] ABSTRACT

A ski carrier apparatus for carrying elongate skiing equipment such as snow skis and ski poles. The apparatus comprises a load-carrying element which is formed from a rod-like structural member, and which is characterized by a concave hook section disposed adjacent one end, and an equipment attachment section disposed adjacent its other end. The load-carrying element is sized to be fitted at its hook section over a single shoulder of a wearer, so that the equipment attachment section may extend diagonally across the wearer's back. Elongate skiing equipment to be carried is secured to the equipment attachment section of the load-carrying element apparatus by an attachment assembly. The elongate skiing equipment may thereupon be carried on the back of a wearer of the apparatus. The apparatus is held in a stable position on the wearer by means of a waist belt engaged with the load-carrying element, and by a shoulder belt engaged at its opposite ends to the waist belt.

4 Claims, 2 Drawing Sheets

SKI CARRIER APPARATUS

FIELD OF THE INVENTION

The present invention generally relates to an apparatus for carrying elongate skiing equipment, and more particularly, to such an apparatus which is worn on a user's body.

SUMMARY OF THE INVENTION

The ski carrier apparatus of the present invention comprises a load-carrying element having a first end and a second end. At the first end of the load-carrying element is formed a hook section, which has a concavity sized to permit the hook section to fit over a single shoulder of a wearer of the apparatus. The load-carrying element also features an equipment attachment section, disposed adjacent the hook section and terminating at the second end; the equipment attachment section is sized to fit diagonally across the back of a wearer of the apparatus. Attachment means, supported by the load-carrying element, are provided for releasably securing elongate skiing equipment, such as skis and poles, to the equipment attachment section. Stabilizer means, supported by the load-carrying element, are provided for releasably holding the load-carrying element in a stable position when the hook section has been fitted over the shoulder of a wearer and the equipment attachment section extends diagonally across the wearer's back.

DETAILED DESCRIPTION OF THE PREFERRED EMBODIMENTS

Figure 1:
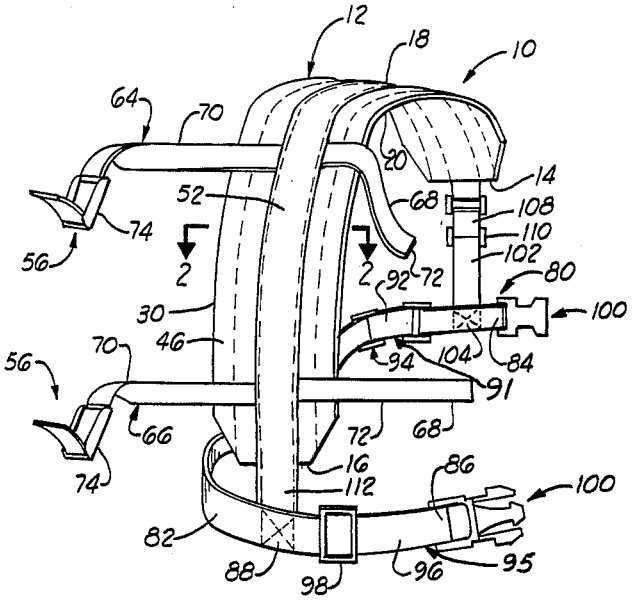
FIG. 1 is a perspective view of a ski carrier apparatus of the present invention.
Figure 3:
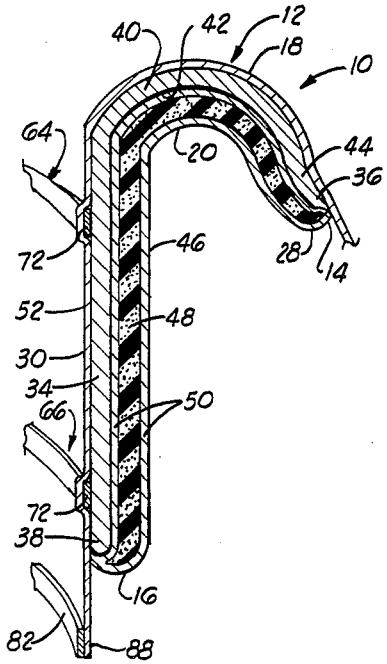
FIG. 3 is a cross-sectional view of the load-carrying element of the ski carrier apparatus along the line 3—3 of FIG. 2.

With reference to FIGS. 1 and 3, the ski carrier apparatus of the present invention, generally designated by reference numeral 10, comprises a load-carrying element 12 having a first end 14 and a second end 16. The load-carrying element 12 should be a strong and durable frame-like structure capable of supporting the weight of elongate skiing apparatus such as snow skis and poles. In addition, the load-carrying element 12 should be sized and constructed so as to fit comfortably against the body contours of a wearer of the apparatus 10, in a manner to be described in greater detail hereafter.

Figure 4:
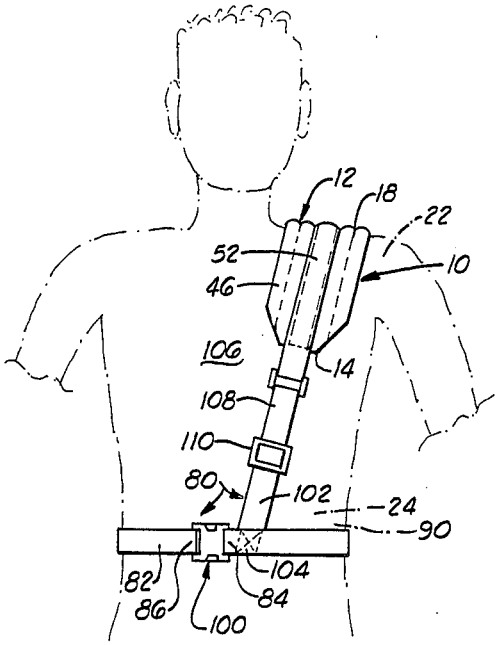
FIG. 4 is a front elevational view of the ski carrier apparatus being worn by a user.
Figure 5:
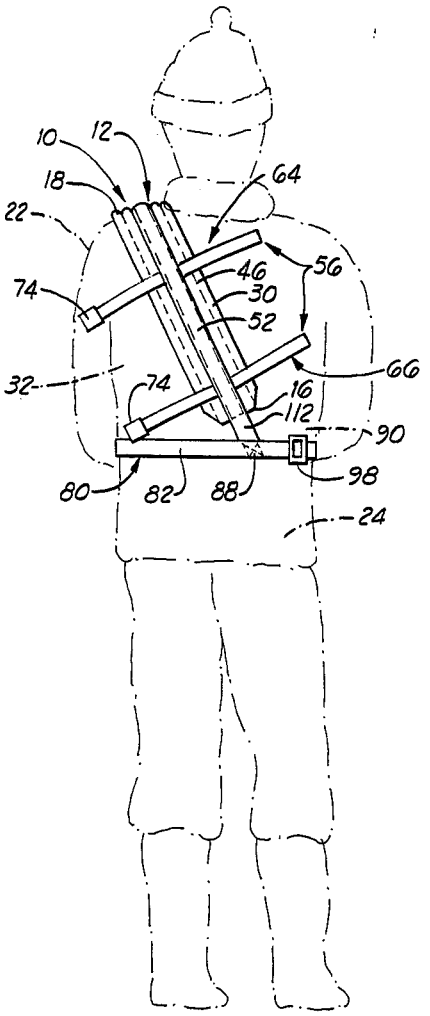
FIG. 5 is a rear elevational view of the ski carrier apparatus being worn by a user.

Formed adjacent the first end 14 of the load-carrying element 12 is a hook section 18, which is characterized by a concavity 20. As shown in FIGS. 4 and 5, the concavity 20 permits the hook section 18 to fit closely over a single shoulder 22 of a wearer 24 of the apparatus 10. Flaring away from the concavity 20 of the hook section 18 is a flared section 28, best shown in FIG. 3, which is formed at the first end 14 of the load-carrying element 12. When the apparatus 10 is being worn, the flared section 28 extends away from the shoulder 22 of a wearer 24, and thus functions to prevent the first end 14 from uncomfortably digging into the shoulder 22 when the apparatus 10 is loaded with elongate skiing equipment.

As shown in FIGS. 1 and 3, the load-carrying element 12 further comprises an equipment attachment section 30, which is integrally disposed adjacent the hook section 18 and which terminates at the second end 16 of the load-carrying element 12. The equipment attachment section 30 is preferably substantially planar and should be of sufficient length and width to permit the stable attachment of elongate skiing equipment thereto. As shown in FIG. 5, the equipment attachment section 30 is sized to fit diagonally across the back 32 of a wearer 24 of the apparatus 10 when the hook section 18 has been fitted on the wearer's shoulder 22.

As will be described in greater detail hereafter, elongate skiing equipment is secured to the apparatus 10 at the equipment attachment section 30 of the load-carrying element 12. As long as the hook section 18 of the load-carrying element 12 engages the shoulder 22 of a wearer 24, the integral equipment attachment section 30 cannot be pulled downward by the weight of skiing equipment. Thus, the shoulder-mounted construction of the load-carrying element 12 offers the advantage of stabilizing skiing equipment against downward movement with respect to the wearer 24.

With reference to FIGS. 1 and 3, the load-carrying element 12 is preferably formed from at least one structural member 34, which preferably comprises at least one rigid strengthening rod. The structural member 34 is preferably formed from a strong, lightweight material such as aluminum, steel, or polymeric material, and functions to impart the requisite strength and shape to the load-carrying element 12.

As shown in FIG. 3, the structural member 34 is characterized by a first end 36, disposed adjacent the first end 14 of the load-carrying element 12, and a second end 38, disposed adjacent the second end 16 of the load-carrying element 12. The structural member 34 is further characterized by a hook section 40, which functions to define the shape of the hook section 18 of the load-carrying element 12. The hook section 40 is characterized by a concavity 42 corresponding to the concavity 20 formed in the load-carrying element 12. At its first end 36, the structural member 34 flares away from the concavity 42. This flared section 44 of the structural member 34 functions to impart the requisite shape to the flared section 28 of the load-carrying element 12.

Figure 2:
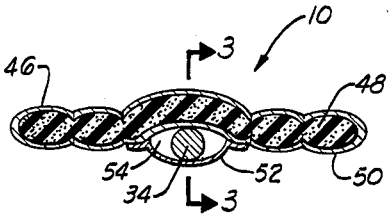
FIG. 2 is a cross-sectional view of the load-carrying element of the ski carrier apparatus along the line 2—2 of FIG. 1.

Further comprising the load-carrying element 12 is a cushion 46, shown in FIGS. 1, 2 and 3, which is supported by the structural member 34 and which preferably is substantially coextensive with the load-carrying element 12. As best shown in FIGS. 3, 4 and 5, the cushion 46 extends in underlying, engaging relationship to the structural member 34 when the apparatus 10 is being worn, so that the cushion 46 is positioned intermediate the structural member 34 and the body of a wearer 24.

With reference to FIGS. 2 and 3, the cushion 46 preferably comprises a core 48, which is formed from a flexible, resilient and lightweight material such as foam rubber. The cushion 46 preferably further comprises a covering 50 which encloses the core 48 and which preferably comprises a flexible, lightweight and water-resistant material such as nylon, and preferably comprises 1000 Denier Cordura Nylon. It is preferred that the cushion 46 be penetrated by one or more lines of stitching, which enhance the structural strength of the cushion 46 and which maintain the covering 50 and core 48 in fixed relationship.

In many instances, the cushion 46 is normally a flat, pad-shaped structure which does not naturally assume the required shape of the load-carrying element 12. Because of the flexibility of the core 48 and covering 50, however, the cushion 46 may be bent or flexed to follow the contours of the structural member 34. A shoulder belt 52 is provided in order to hold the cushion 46 in this bent or flexed position, in underlying, engaging relationship to the structural member 34.

The shoulder belt 52 preferably comprises a strong, elongate piece of webbing material, such as Southern Weaving Co. Model 1133UL two-inch propylene webbing. The shoulder belt 52 extends in overlying relationship to both the structural member 34 and the cushion 46, and is attached at its opposite lateral edges to the cushion 46 by means of stitching, rivets, snaps or other attachment devices. As thus attached, the shoulder belt 52 and cushion 46 cooperate to engage the structural member 34 along its entire length, thereby constraining both the shoulder belt 52 and the cushion 46 to follow the contours of the structural member 34. As shown in FIG. 2, the cooperation of the shoulder belt 52 and the cushion 46 functions to confine the structural member 34 in a tightly fitting pocket 54 within the load-carrying element 12.

When the apparatus 10 is worn, the cushion 46 comprises the portion of the load-carrying element 12 which contacts the body of the wearer 24, as shown in FIGS. 3, 4, 5 and 6. The cushion 46 thus functions to enhance the comfort of the apparatus 10 for the wearer 24. At the same time, the cushion 46 should be characterized by sufficient rigidity so that it can cooperate with the structural member 34 and the shoulder belt 52 to form a load-bearing platform, to which elongate skiing equipment may be secured.

With reference to FIGS. 1, 3, 5 and 6, the ski carrier apparatus 10 further comprises an attachment assembly 56, supported by the load-carrying element 12, which functions to releasably secure elongate skiing equipment 58, such as snow skis 60 and ski poles 62, to the equipment attachment section 30. The attachment assembly 56 preferably comprises a first strap assembly 64 supported by the equipment attachment section 30 of the load-carrying element 12. Further comprising the attachment assembly 56 is a second strap assembly 66, also supported by the equipment attachment section 30 of the load-carrying element 12, at a location spaced from that of the first strap assembly 64.

Each of the first and second strap assemblies 64 and 66 is preferably formed from a first section 68 and a second section 70, each formed from a strong and flexible strap material, such as Southern Weaving Co. Model 1133NL one-inch straps. Each of the sections 68 and 70 is characterized by a free end and by a fixed end secured to the load-carrying element 12. The free ends of each set of adjacent sections 68 and 70 should be positioned in sufficient proximity to permit each set of sections 68 and 70 to form a tight, equipment-retaining loop, as will be described in greater detail hereafter.

In one preferred embodiment, shown in the Figures, the first section 68 and second section 70 of each strap assembly 64 and 66 comprise a single, continuous strap 72 which is secured to the load-carrying element 12 at a central position along its length. Each of the straps 72 extends transversely underneath the shoulder belt 52, and is secured to the load-carrying element 12 and the shoulder belt 52, at the area of intersection between the strap 72 and the shoulder belt 52. Attachment of the straps 72 to the shoulder belt 52 and load-carrying element 12 is preferably effected by stitching, although rivets, snaps or other attachment devices may also be used.

With continued reference to FIGS. 1 and 5, mechanical fastening devices 74, such as buckles, are preferably provided to releasably join the first and second sections 68 and 70 of each strap assembly 64 and 66, as required to maintain an equipment-retaining loop in each strap assembly. A preferred fastening device is the ITW Nexus Products Model CB one-inch buckle. Alternatively, other fastening methods, such as knots, may be used in lieu of mechanical fastening devices in order to maintain a tight, equipment-retaining loop in each strap assembly 64 and 66.

Figure 6:
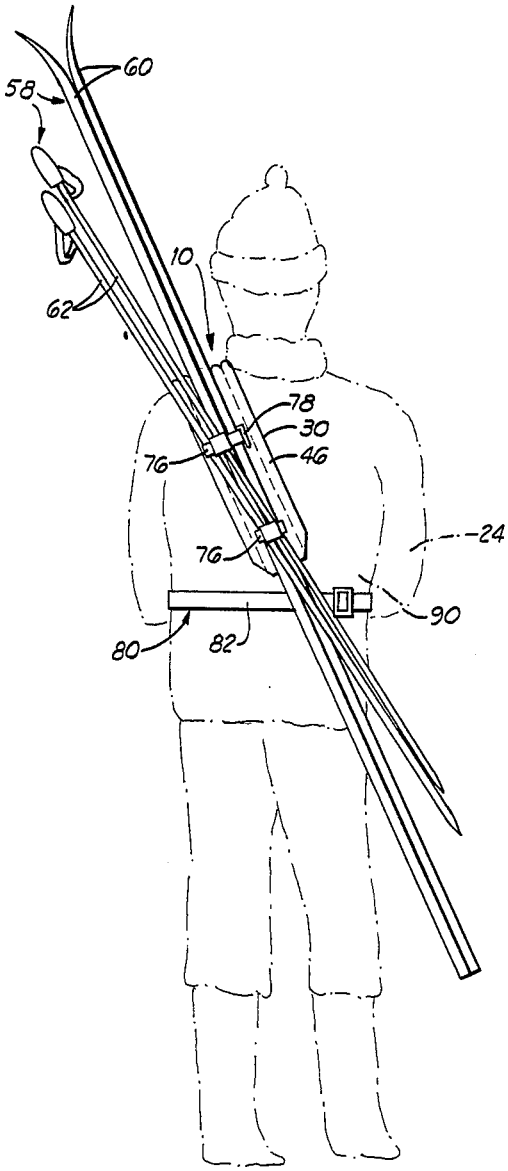
FIG. 6 is a rear elevational view of the ski carrier apparatus, with skis and ski poles attached, being worn by a user.
Figure 7:
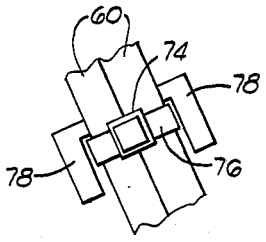
FIG. 7 is a detailed view of the ski carrier apparatus of the present invention, showing the interaction of the first strap assembly with a pair of skis being carried by the apparatus.
Figure 8:
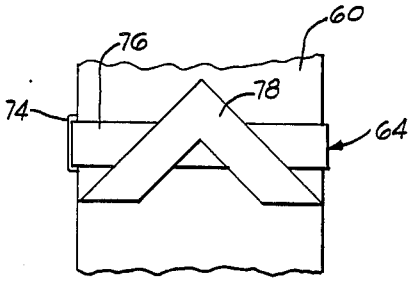
FIG. 8 is a detailed side view of the first strap assembly and skis shown in FIG. 7.

As shown in FIGS. 6, 7 and 8, elongate skiing equipment 58 may be secured to the load-carrying element 12 by joining the first and second sections 68 and 70 of each strap assembly 64 and 66 to form a tight, equipment-retaining loop 76 which surround the equipment 58. These loops 76 are held in a tight configuration by fastening devices 74. Release of the fastening devices 74 permits release of the elongate skiing equipment 58 from the equipment-retaining loops 76, and thus from the load-carrying element 12.

The first strap assembly 64 is preferably positioned on the load-carrying element 12 so that when one or more skis 60 are being carried in the apparatus 10, with tips oriented upwardly, the first strap assembly 64 can interengage, and preferably underextend, the toe bindings 78 of one or more of the skis 60 being carried in the apparatus 10. The mechanical interaction between the toe bindings 78 and the first strap assembly 64 serves to enhance the security with which the skis 60 are held to the load-carrying element 12 by the attachment assembly 56. Even if one or more of the equipment-retaining loops 76 should become loosened, the mechanical interaction of the first strap assembly 64 with the toe bindings 78 will nevertheless prevent the skis 60 from slipping to the ground.

While the attachment assembly 56 preferably comprises two spaced strap assemblies, it should be understood that the attachment assembly 56 may also comprise three or more spaced strap assemblies positioned on the load-carrying element 12. Moreover, other types of attachment devices may be used in lieu of the strap assemblies contemplated by the preferred embodiment of the attachment assembly 56.

With reference to FIGS. 1, 4 and 5, the ski carrier apparatus 10 of the present invention further comprises a stabilizer assembly 80, which is supported by the load-carrying element 12. The stabilizer assembly 80 functions to releasably hold the load-carrying element 12 in a stable position when the hook section 18 has been fitted over the shoulder 22 of a wearer 24 of the apparatus and when the equipment attachment section 30 fittingly extends diagonally across the back 32 of the wearer 24. The stabilizer assembly 80 thus operates to restrain unwanted movement of elongate skiing equipment 58 carried in the apparatus 10 when the wearer 24 is on foot, as shown in FIG. 6.

As shown in FIGS. 1, 3, 4, 5 and 6, the stabilizer assembly 80 preferably comprises a waist belt 82, having a first end 84 and a second end 86. The waist belt 82 is supported by the equipment attachment section 30 and a connecting section 88, and is preferably formed from a strong, lightweight and flexible material. In many instances, the waist belt 82 may be formed from the same material as the shoulder belt 52. The waist belt 82 is preferably sized to fittingly extend around the waist 90 of a wearer 24 of the apparatus 10, although the waist belt 82 may also be extended around the wearer's trunk above or below the waist 90.

In many instances, it will be desirable to form the waist belt 82 so that it can adjust in length to fit a range of wearers having different waist measurements. In this event, the apparatus 10 preferably comprises a first length adjustment assembly 91, supported by the waist belt 82, which functions to vary the effective length of the waist belt 82 adjacent its first end 84. The first length adjustment assembly 91 preferably comprises a first looped section 92 formed in the waist belt 82 adjacent its first end 84, and a first slide element 94, which interengages the first looped section 92 and the adjacent section of the waist belt 82. A preferred looped section 92 comprises the ITW Nexus Products Model LP two-inch loop, and a preferred slide element 94 comprises the ITW Nexus Products Model TG two-inch slide bar. Movement of the first slide element 94 on the waist belt 82 permits the length of the first looped section 92 to be varied, as required to adjust the effective length of the waist belt 82.

In one preferred embodiment, the waist belt 82 further comprises a second length adjustment assembly 95, supported by the waist belt 82, and disposed on the opposite side of the rear connecting section 88 from the first length adjustment assembly 91. The second length adjustment assembly 95 functions to vary the effective length of the waist belt 82 adjacent its second end 86, and preferably comprises a second looped section 96 formed in the waist belt 82, and a second slide element 98 which interengages the second looped section 96 and the adjacent section of the waist belt 82. The length of the second looped section 96 may be controlled by the second slide element 98, as required to vary the effective length of the waist belt 82. Preferably the second loop section 96 is identical in construction to the first loop section 92, and the second slide element 98 is identical in construction to the first slide element 94. The provision of two length adjustment assemblies 91 and 95 on opposite sides of the rear connecting section 88 permits the effective length of the waist belt 82 to be varied, as required to accommodate different waist sizes, without displacing the equipment attachment section 30 from its preferred position in diagonal extension across the back 32 of a wearer 24.

As shown in FIGS. 1 and 4, the stabilizer assembly 80 preferably further comprises a belt fastening assembly 100, supported by the waist belt 82, for releasably interengaging the first end 84 and second end 86 of the waist belt 82. The belt fastening assembly 100 preferably comprises intermating tongue and buckle elements supported on the first and second ends 84 and 86. A preferred belt fastening assembly 100 comprises the ITW Nexus Products Model SR two-inch buckle.

As shown in FIG. 4, the waist belt 82 is preferably formed so that the belt fastening assembly 100 is positioned immediately to the front of the wearer 24, in order to facilitate manual access to the belt fastening assembly 100. The provision of two separate looped sections 92 and 96 and slide elements 94 and 98 permit the effective length of the waist belt 82 to be varied without disturbing this preferred central and frontal positioning of the belt fastening assembly 100.

When the waist belt 82 extends around the waist 90 of a wearer 24 and is held in place by the belt fastening assembly 100 as shown in FIGS. 4 and 5, the load-carrying element 12 is stabilized against unwanted transverse movement of the equipment section 30 on the back 32 of a wearer 24. At the same time, the waist belt 82 functions to transfer a portion of the load associated with elongate skiing equipment 58 away from the shoulders and back of a wearer and toward the wearer's hips. This load redistribution offers greater comfort and less fatigue to a wearer who carries elongate skiing equipment in the apparatus 10.

With reference to FIGS. 1 and 4, the stabilizer assembly 80 preferably further comprises a first cross belt 102 which interengages the first end 14 of the load-carrying element 12 and the waist belt 82. The first cross belt 102 should be formed from a strong, lightweight and flexible material, and is attached to the waist belt 82 at a front connecting section 104 of the waist belt 82. Preferably, the front cross belt 102 is secured to the front connecting section 104 by stitching, although rivets, snaps or other attachment devices may also be used.

As shown in FIG. 4, the first cross belt 102 fittingly extends diagonally across the chest 106 of a wearer 24 of the apparatus 10. The first cross belt 102 thus functions to stabilize the load-carrying element 12 against unwanted vertical motion of the load-carrying element 12 when the apparatus 10 is in use by a wearer 24. At the same time, the first cross belt 102 also contributes to shifting the load associated with elongate skiing equipment to the waist belt 82 and thus away from the shoulders and back of the wearer of the apparatus 10.

In many instances, it will be desired for the first cross belt 102 to fit a range of wearers having different chest and trunk measurements. In this event, the first cross belt 102 may be provided with a cross looped section 108 and a cross slide element 110, each preferably identical in construction to the respective first and second looped sections 92 and 96 and the first and second slide elements 94 and 98 described previously. The length of the cross looped section 108, and thus the effective length of the first cross belt 102, can be varied by movement of the cross slide element 110. This variation in effective length permits the first cross belt 102 to be fitted to a range of wearers with differing chest and trunk measurements.

As shown in FIGS. 1 and 5, the stabilizer assembly 80 is preferably interengaged to the second end 16 of the load-carrying element 12 by a second cross belt 112, which is formed from a strong, flexible lightweight material, and is preferably formed from the same material as the first cross belt 102. The second cross belt 112 is attached at one end to the second end 16 of the load-carrying element 12 and is attached at its other end to the rear connecting section 88 of the waist belt 82. The connection at the rear connecting section 88 is preferably formed by stitching, although rivets, snaps or other attachment devices may also be used.

As best shown in FIG. 1, the first and second cross belts 102 and 112 most preferably comprise integral end sections of the shoulder belt 52. In this embodiment, one end of the shoulder belt 52 is engaged with the waist belt 82 at the rear connecting section 88 and the opposite end of the shoulder belt 52 is engaged with tee waist belt 82 at the front connecting section 104. This integration of the first and second cross belts 102 and 112 into the shoulder belt 52 enhances the strength and durability of the apparatus 10.

It will be noted that, in the embodiment shown in FIGS. 4, 5 and 6, the stabilizer assembly 80 has been formed so that the load-carrying element 12 must be worn over the left shoulder 22 of the wearer 24. However, the stabilizer assembly 80 may also be constructed so as to permit the load-carrying element 12 to also be worn over the right shoulder of a wearer.

Because a skier must unavoidably carry a substantial amount of heavy equipment to a ski area, optional skiing accessories should be as lightweight as possible. Likewise, because optional skiing accessories must often be stored in small lockers while a skier is on the slopes, it is necessary that these skiing accessories also be as compact as possible. From the foregoing description, it will be appreciated that the ski carrier apparatus 10 of the present invention offers the combination of low weight and compactness which is most desirable in an optional skiing accessory.

The compactness and low weight of the apparatus 10 can be attributed to the use of a load-carrying element 12 which fits over a single shoulder of a wearer. A load-carrying element 12 of such low weight and volume can be employed because the apparatus 10 of the present invention stabilizes the elongate skiing equipment carried on the shoulder-mounted load-carrying element 12. This stabilization is brought about by the interaction of the hook section 18 with the shoulder 22 of a wearer and by the action of the stabilizer assembly 80, which imparts additional vertical and horizontal stability to the equipment attachment section 30. These stabilizing features do not detract substantially from the weight and volume advantages of the apparatus 10.

With reference to FIGS. 4, 5 and 6, elongate skiing equipment 58 is preferably releasably secured to the apparatus 10 before the apparatus 10 is donned by the wearer 24. Skiing equipment 58 is secured to the equipment attachment section 3 in the equipment-retaining loops 76 formed by the attachment assembly 56. After the skiing equipment 58 is thus secured, the wearer 24 fits the hook section 18 over a single shoulder 22, so that the equipment attachment section 30, and the elongate skiing equipment 58 carried therein, extends diagonally across the wearer's back 32.

After the load-carrying element 12 has been positioned as described above, the ends of the waist belt 82 are joined with the belt fastening assembly 100, so that the waist belt 82 fittingly extends around the wearer's waist 90, or other portions of the wearer's trunk. If necessary, the length of the waist belt 82 and first cross belt 102 may be adjusted for a comfortable and close fit, by movement of the first and second slide elements 94 and 98 and the cross slide element 110. The wearer may then travel to any desired destination, with the elongate skiing equipment 58 safely, stably and comfortably positioned across the wearer's back 32.

Upon arrival at the destination, the wearer 24 may disconnect the belt fastening assembly 100 and lift the load-carrying element 12 and the attached skiing equipment 58 from the shoulder 22. Elongate skiing equipment 58 may then be released and removed from the attachment assembly 56, and the apparatus 10 stored pending further use.

Changes may be made in the construction and operation of the various parts, elements and assemblies described herein without departing from the spirit and scope of the invention as defined in the following claims.

What is claimed is:

1. An apparatus for carrying elongate skiing equipment, comprising:

a load-carrying element having a first end and a second end, the load-carrying element comprising:

a hook section formed adjacent the first end of the load-carrying element, the hook section having a concavity sized to permit the hook section to fit over a single shoulder of a wearer of the apparatus; and an equipment attachment section disposed adjacent the hook section and terminating at the second end of the load-carrying element, the equipment attachment section sized to fit diagonally across the back of a wearer of the apparatus;

attachment means, supported by the load-carrying element, for releasably securing elongate skiing equipment to the equipment attachment section;

stabilizer means, supported by the load-carrying element, for releasably holding the load-carrying element in a stable position when the hook section has been fitted over the shoulder of a wearer and the equipment attachment section extends diagonally across the wearer's back, comprising:

a waist belt supported by the equipment attachment section and having a first end and a second end, the waist belt sized to fittingly extend around the waist of a wearer of the apparatus, a first cross belt which interengages the first end of the load-carrying element and the waist belt; and a second cross belt which interengages the second end of the load-carrying element and the waist belt;

in which the first and second cross belts are integral sections of a shoulder belt which extends in overlying relationship to the load-carrying element and which is engaged with the waist belt.

2. The apparatus of claim 1 in which the load-carrying element comprises:

a structural member having a first and second end, and having a concave hook section formed adjacent the first end; and a cushion supported by the structural member and extending in underlying relationship thereto so that the cushion is positionably intermediate the structural member and the body of a wearer of the apparatus;

and in which the shoulder belt extends in overlying relationship to the structural member.

3. The apparatus of claim 1 in which the attachment means comprises:

a first strap assembly supported by the load-carrying element; and a second strap assembly supported by the load-carrying element at a location spaced from the first strap assembly;

and in which the first and second strap assemblies are held in engagement to the load-carrying element by the shoulder belt.

4. An apparatus for carrying elongate skiing equipment, comprising:

a load-carrying element having a first end and a second end, the load-carrying element comprising:

a hook section formed adjacent the first end of the load-carrying element, the hook section having a concavity sized to permit the hook section to fit over a single shoulder of a wearer of the apparatus; and an equipment attachment section disposed adjacent the hook section and terminating at the second end of the load-carrying element, the equipment attachment section sized to fit diagonally across the back of a wearer of the apparatus;

attachment means, supported by the load-carrying element, for releasably securing elongate skiing equipment to the equipment attachment section; and stabilizer means, supported by the load-carrying element, for releasably holding the load-carrying element in a stable position when the hook section has been fitted over the shoulder of a wearer and the equipment attachment section extends diagonally across the wearer's back, comprising:

a waist belt supported by the equipment attachment section and having a first end and a second end, the waist belt sized to fittingly extend around the waist of a wearer of the apparatus;

a first cross belt which interengages the first end of the load-carrying element and the waist belt; and belt fastening means, supported by the waist belt, for releasably interengaging the first and second ends of the waist belt;

in which the first cross belt engages the waist belt on the same side of the belt fastening means that the hook section of the load-carrying element is positioned.

* * * * *